United States Patent [19]

Dewoolfson

[11] 4,324,325

[45] Apr. 13, 1982

[54] APPARATUS FOR COLLECTION OF METALLIC CONTAINERS AND METHOD THEREFOR

[76] Inventor: Bruce H. Dewoolfson, 2200 Columbia Pike #1113, Arlington, Va. 22204

[21] Appl. No.: 106,104

[22] Filed: Dec. 21, 1979

[51] Int. Cl.[3] ..... G07F 7/06

[52] U.S. Cl. ..... 194/4 C; 100/902; 194/1 E; 194/4 E

[58] Field of Search ..... 194/1 E, 4 B, 4 C, 4 D, 194/4 E, 4 F, 4 G, 4 R; 100/DIG. 2; 209/567, 570, 571, 600; 324/228; 221/84

[56] References Cited

U.S. PATENT DOCUMENTS

| | | | |
|---|---|---|---|
| Re. 27,643 | 5/1973 | Myers | 194/4 C |
| 1,901,528 | 3/1933 | Olsen . | |
| 2,558,255 | 6/1951 | Johnson et al. . | |
| 2,691,379 | 10/1954 | Foushee | 133/5 R |
| 2,908,440 | 10/1959 | Gurewitz . | |
| 2,954,111 | 9/1960 | Garrard . | |
| 3,015,376 | 1/1962 | Glembring . | |
| 3,039,583 | 6/1962 | Menefee . | |
| 3,066,600 | 12/1962 | Couty et al. . | |
| 3,191,609 | 6/1965 | Gauselmann et al. . | |
| 3,343,638 | 5/1967 | Putman . | |
| 3,489,354 | 2/1968 | Harper et al. . | |
| 3,776,128 | 12/1973 | Morris . | |
| 3,792,765 | 2/1974 | Arp | 194/4 C |
| 3,857,334 | 12/1974 | Arp . | |
| 3,907,087 | 9/1975 | Tanaka . | |
| 4,010,766 | 3/1977 | Bowles et al. . | |
| 4,091,725 | 5/1978 | Arp | 100/DIG. 2 X |
| 4,141,493 | 2/1979 | Arp | 194/4 R X |
| 4,248,334 | 2/1981 | Hanley et al. | 194/4 C |

FOREIGN PATENT DOCUMENTS

| | | | |
|---|---|---|---|
| 354258 | 7/1905 | France | 221/84 |

OTHER PUBLICATIONS

U.S. Patent Application Serial No. 742,662, Arp, filed Nov. 17, 1976, now abandoned.

U.S. Patent Application Serial No. 612,088, Arp, filed Sep. 10, 1975, now abandoned.

*Primary Examiner*—Robert J. Spar
*Assistant Examiner*—Edward M. Wacyra
*Attorney, Agent, or Firm*—Finnegan, Henderson, Farabow, Garrett & Dunner

[57] ABSTRACT

Apparatus for collection of metallic containers and for dispensing tokens therefo, including an exterior housing having an access port therein; a rotating belt havig a plurality of generally horizontal shelves formed thereon, each shelf for receiving and supporting a container, a pair of curved actuator arms for passing an electric current directly through the container for identifying a specific predetermined metallic composition, a dispenser for selectively dispensing a token for a received container having the predetermined metallic composition, a crusher cooperating with the rotating belt for crushing the container, and a hopper for storing the crushed containers.

14 Claims, 7 Drawing Figures

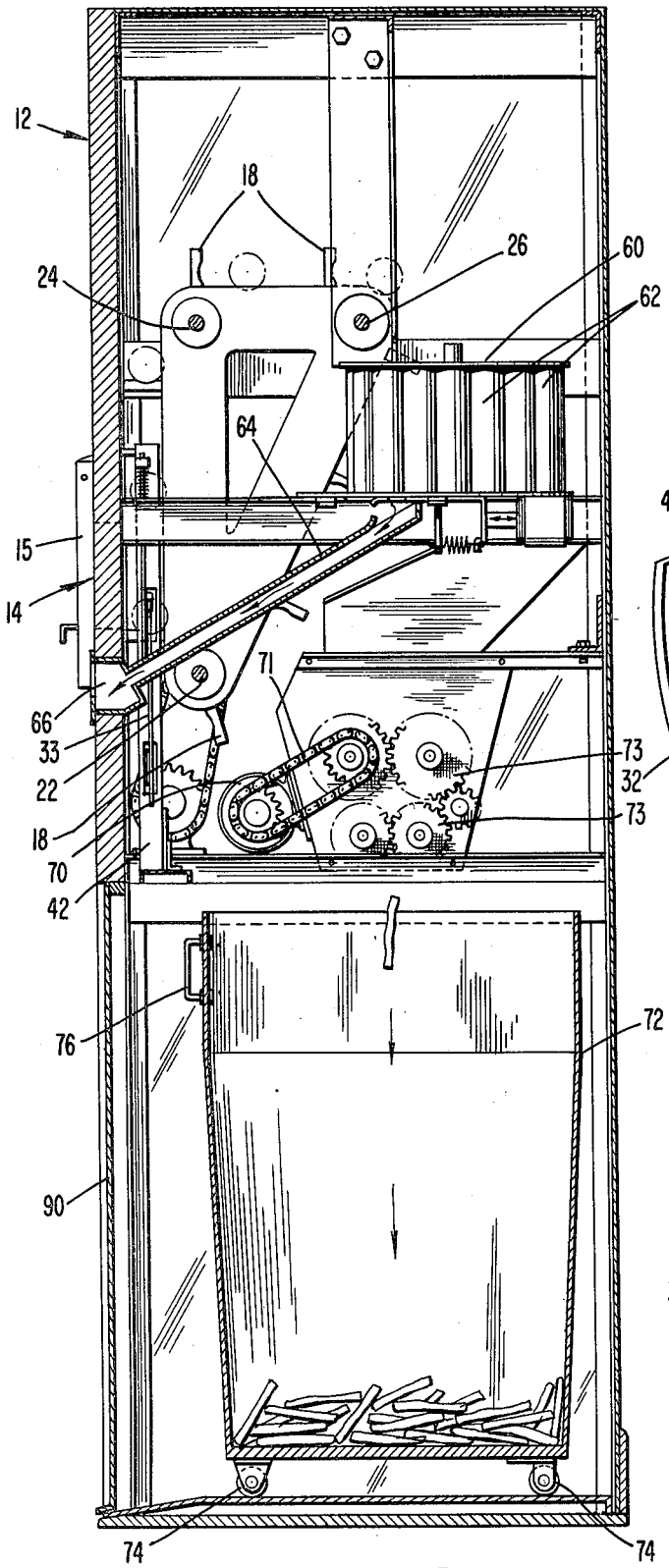
Fig. 3
Fig. 4
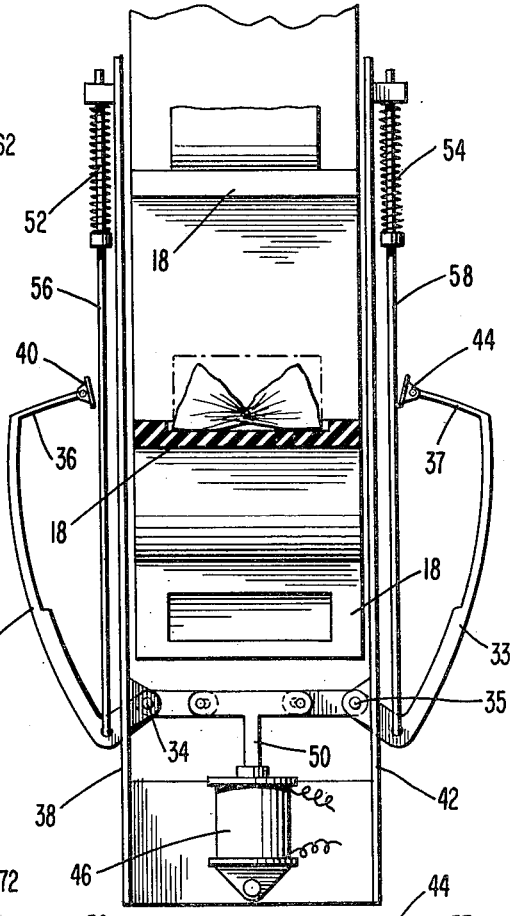
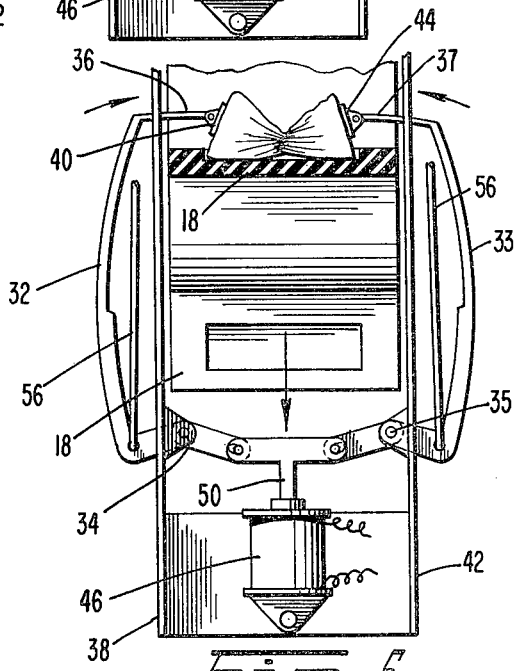
Fig. 5

APPARATUS FOR COLLECTION OF METALLIC CONTAINERS AND METHOD THEREFOR

BACKGROUND OF THE INVENTION

This invention relates to apparatus for collecting and storing used metallic containers and, more particularly, machines for collecting, crushing and storing used aluminum beverage cans in recycling, and for dispensing tokens in exchange for containers collected.

With the increasing emphasis in recent years on energy conservation, the recycling of metallic containers such as beverage cans has become an important factor in the conservation effort. More specifically, the recycling of aluminum cans has proven to be remarkably efficient in energy saving. Yet only a fraction of the tool annual production of aluminum beverage cans is recovered after use, with the remainder being discarded. This tremendous waste, to date, has been largely due to the lack of an efficient and economically feasible unit recovery system. Several machines have been developed in the prior art for encouraging the recovery and recycling of metallic containers. For example, U.S. Pat. Nos. 3,857,334 and 3,907,087 disclose apparatus for crushing metallic containers and discharging refund coins or tokens in exchange therefor. U.S. Pat. No. RE 27,643 describes a process and apparatus for collection of metal containers in which tokens are automatically dispensed for the containers collected. In general, the prior art machines induct any type of inserted container, and then utilize some type of sensing means for differentiating between those containers for which a token is to be dispensed and those containers for which no payment is to be made. For example, Arp, U.S. Pat. No. 3,857,334 includes control means for issuing a token only when cans of a given size, weight and design are crushed in the machine. Myers, U.S. Pat. No. RE 27,643 discloses a mechanism which utilizes a plurality of bar magnets for separating cans formed of magnetic material from non-magnetic cans.

Several of the prior art apparatus are designed to take advantage of the force of gravity in feeding the metallic containers into the apparatus. This type of feeding mechanism has an inherent drawback in that the containers must be sufficiently close to their original shape to roll down an inclined surface. As a result, a large majority of containers which have been totally or partially crushed by the user, cannot be fed into such machines efficiently. In addition, the sensing or differentiating mechanisms of the prior art machines do not appear to be adaptable to operation on partially or fully crushed containers of different sizes.

Accordingly, it is a primary object of this invention to provide an improved container collection apparatus which is capable of readily accepting containers in their originally manufactured shape, or containers which have been manually deformed by consumers.

It is a further object of this invention to provide a container collection machine with a sensing mechanism which can readily detect the presence of aluminum containers of varying sizes, and can do so prior to accepting the inserted container into the interior of the machine.

Another object of the invention is to provide an improved container collection apparatus with a mechanism for detecting the presence of aluminum containers which have been deformed from their originally manufactured shape.

It is an additional object of this invention to provide an improved method of collecting and storing empty aluminum containers and issuing a token therefor.

Additional objects and advantages of the invention will be set forth in part in the description which follows and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects and in accordance with the purpose of the invention as embodied and broadly described herein, the apparatus of this invention comprises preselection means for passing an electric current directly through a crushed or non-crushed container offered by a customer for identifying whether the container is substantially aluminum, the preselection means including a container access area configured to accommodate both crushed and non-crushed containers for passage of the electric current therethrough; means for accepting only a container identified by the preselection means as being substantially aluminum, independent of the configuration of the container; dispensing means responsive to the preselection means for dispensing payment in return for containers having a substantially aluminum composition; means cooperating with the accepting means for crushing the containers; and means for storing crushed containers received from the crushing means.

Preferably, the preselection means includes a pair of curved actuator arms for establishing positive electrical contact with spaced-apart locations on the container. It is also preferred that one end of each actuator arm be pivotably mounted for arc-rotation in the apparatus.

The accepting means preferably includes conveying means for receiving the containers and depositing the containers by gravity into the crushing means. The conveying means preferably includes a rotating belt having a plurality of generally horizontal shelves formed thereon, each of the shelves for receiving and supporting a container.

Preferably also, the apparatus includes an exterior housing having an access port therein, one of the shelves being positioned adjacent the port for allowing manual insertion of a container into the housing onto the one shelf. The apparatus may also include a door covering the access port and means preventing operation of the apparatus when the door is open.

BRIEF DESCRIPTION OF THE DRAWINGS

The accompanying drawings which are incorporated in and constitute a part of the specification, illustrate one embodiment of the invention, and, together with the description, serve to explain the principles of the invention.

Of the drawings:

FIG. 3 is a right side cutaway view of the interior of the apparatus taken generally along the line 3—3 of FIG. 2.

FIG. 4 is an isolated view of the sensing mechanism of the invention with the sensing arms in the open position.

FIG. 5 is an isolated view of a portion of the sensing mechanism with the sensing arms in the closed position.

DESCRIPTION OF THE PREFERRED EMBODIMENT

Figure 1:
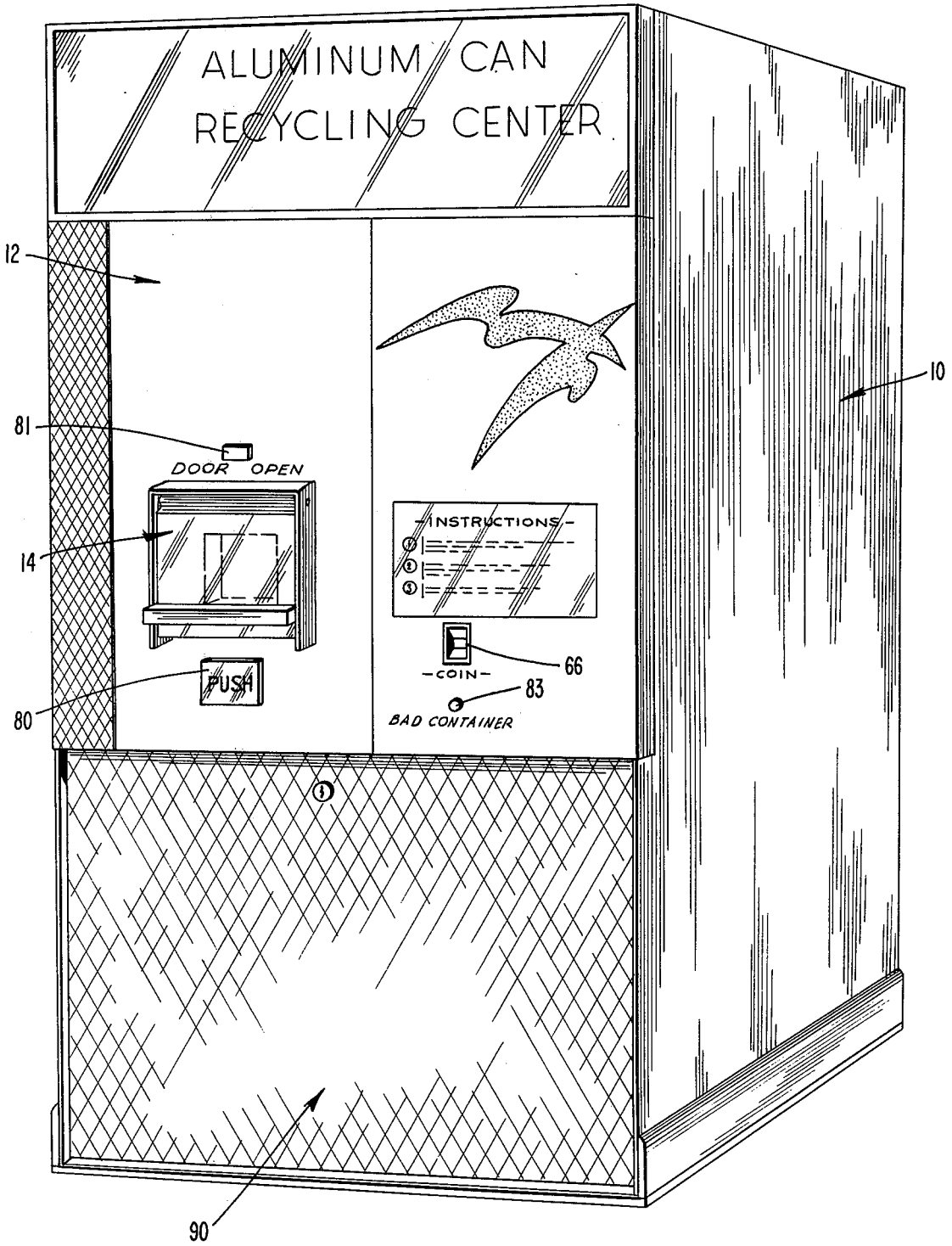
FIG. 1 is perspective view of the exterior of the apparatus.
Figure 2:
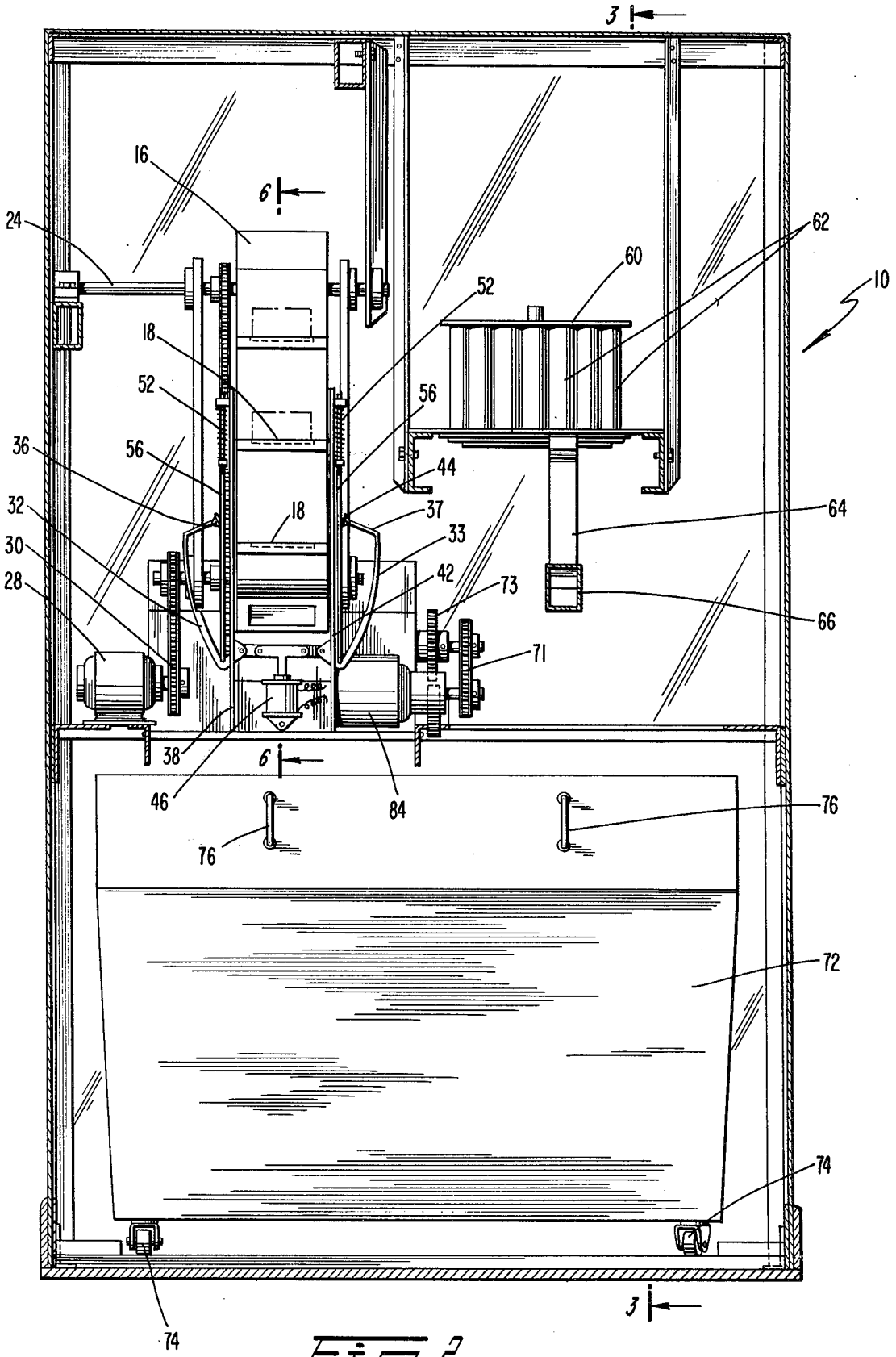
FIG. 2 is cutaway front view of the interior portion of the apparatus.

Reference will now be made in detail to the present preferred embodiment, an example of which is illustrated in the accompanying drawings. Referring now to FIGS. 1, 2 and 3, it may be seen that the container collection apparatus provides a rapid and efficient means for collecting containers for recycling. The apparatus for collection of containers generally includes a rectangular cabinet housing 10 having a front wall 12 which is hinged to allow access to the interior of the housing 10 for maintenance of the operating components and to allow for removal of the containers collected in the apparatus.

In accordance with the invention, the apparatus includes preselection means for passing an electric current directly through a crushed or non-crushed container offered by a customer for identifying whether the container is substantially aluminum, the preselection means including a container access area configured to accommodate both crushed and non-crushed containers for passage of the electric current therethrough. As embodied herein, the preselection means includes an access port 14 in the front wall 12 of the housing 10. A door 15 covers the access port 14, and the door 15 may be provided with an electronic locking mechanism (not shown) which prevents operation of the apparatus when the door 15 is unlocked. The door 15 may also include means for automatically opening the door upon unlocking, such as a spring.

Figure 6:
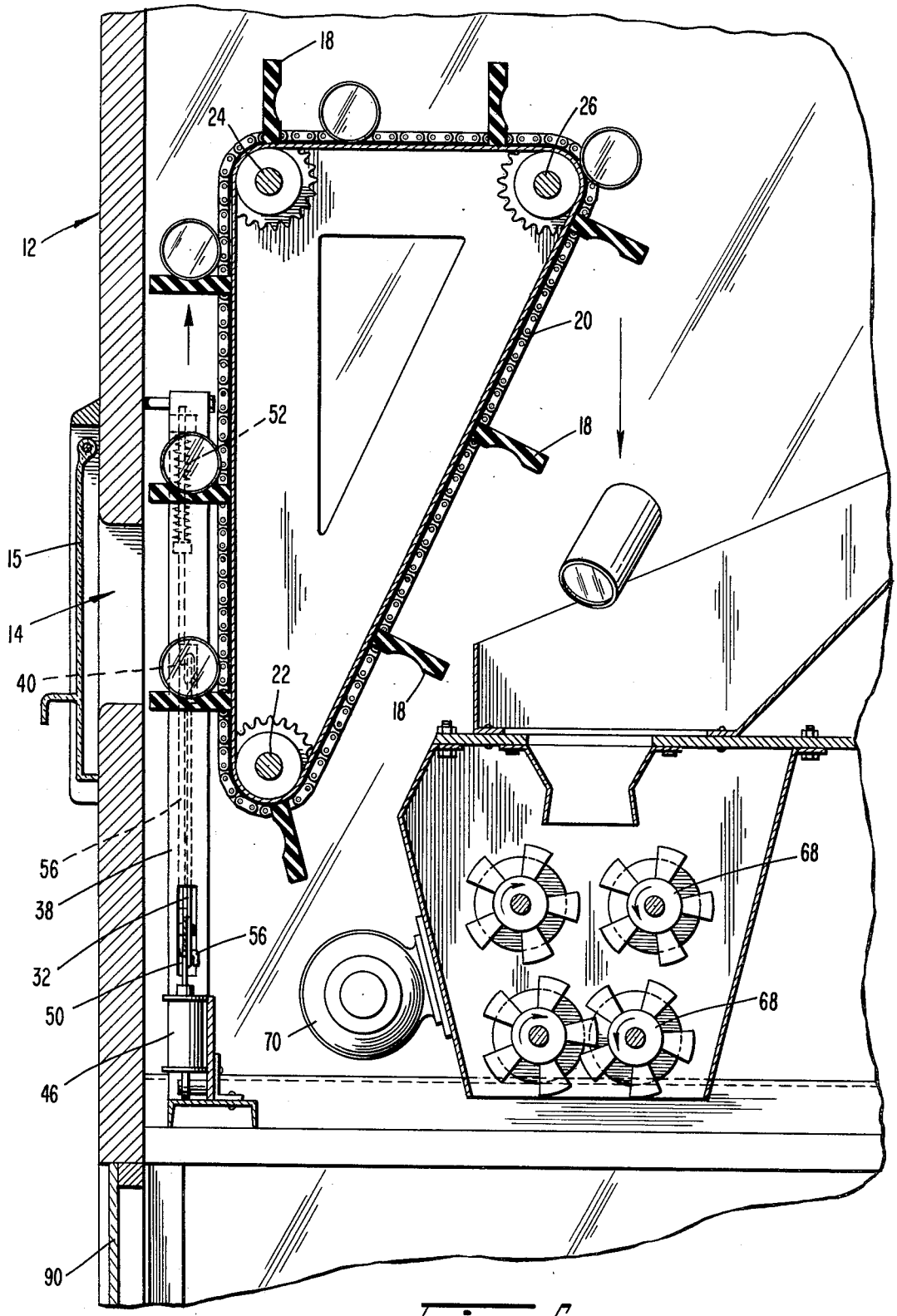
FIG. 6 is an enlarged cross-sectional view taken generally along the line 6—6 in FIG. 2.

In accordance with the invention, the apparatus also includes means for accepting only a container identified by the preselection means as being substantially aluminum, independent of the configuration of the container. Preferably, the accepting means also includes conveying means for lifting the containers and depositing the containers by gravity into a crushing means. The conveying means preferably includes a rotating belt having a plurality of generally horizontal shelves formed thereon, each of the shelves for receiving and supporting a container. As here embodied, the conveying means includes a belt 16 formed of a flexible material such as rubber. The belt has a plurality of shelves 18 formed thereon at spaced intervals, each shelf for receiving and supporting a container. The shelves 18 are preferably formed of hard rubber or some other suitable non-conductive material. The belt 16 is mounted within the housing to allow individual alignment of the shelves with the access port 14. During operation, the belt 16 rotates at evenly spaced intervals, equal to the distance between two adjacent shelves 18. In the illustrated embodiment, the belt 16 is mounted for rotation in a triangular configuration as shown in FIG. 6. The belt is controlled by a chain drive utilizing a chain 20 and three pinion gears, 22, 24 and 26. A suitable electric motor 28 is operatively connected through another chain 30 to provide power for the rotation of chain 20.

Preferably the preselection means includes a pair of curved actuator arms for establishing electrical contact with spaced-apart locations on the container. One end of each of the actuator arms is also preferably pivotably mounted for arc-rotation in the apparatus. As here embodied and as best shown in FIGS. 4 and 5, the preselection means includes a pair of curved actuator arms 32 and 33 arranged for arc-rotation within the housing 10 on opposite sides of the access port 14. One end 34 of the actuator arm 32 is pivoted in a frame 38 which extends parallel to the belt 16 on one side thereof. The opposite end 36 of the arm 32 has an enlarged electrically-conductive contact pad 40 pivotally attached thereto. Similarly, one end 35 of the arm 33 is pivoted in a frame 42 extending parallel to the belt 16 on the other side thereof. The opposite end 37 of the arm 33 includes an enlarged electrically-conductive contact pad 44 pivotally mounted thereon.

Figure 7:
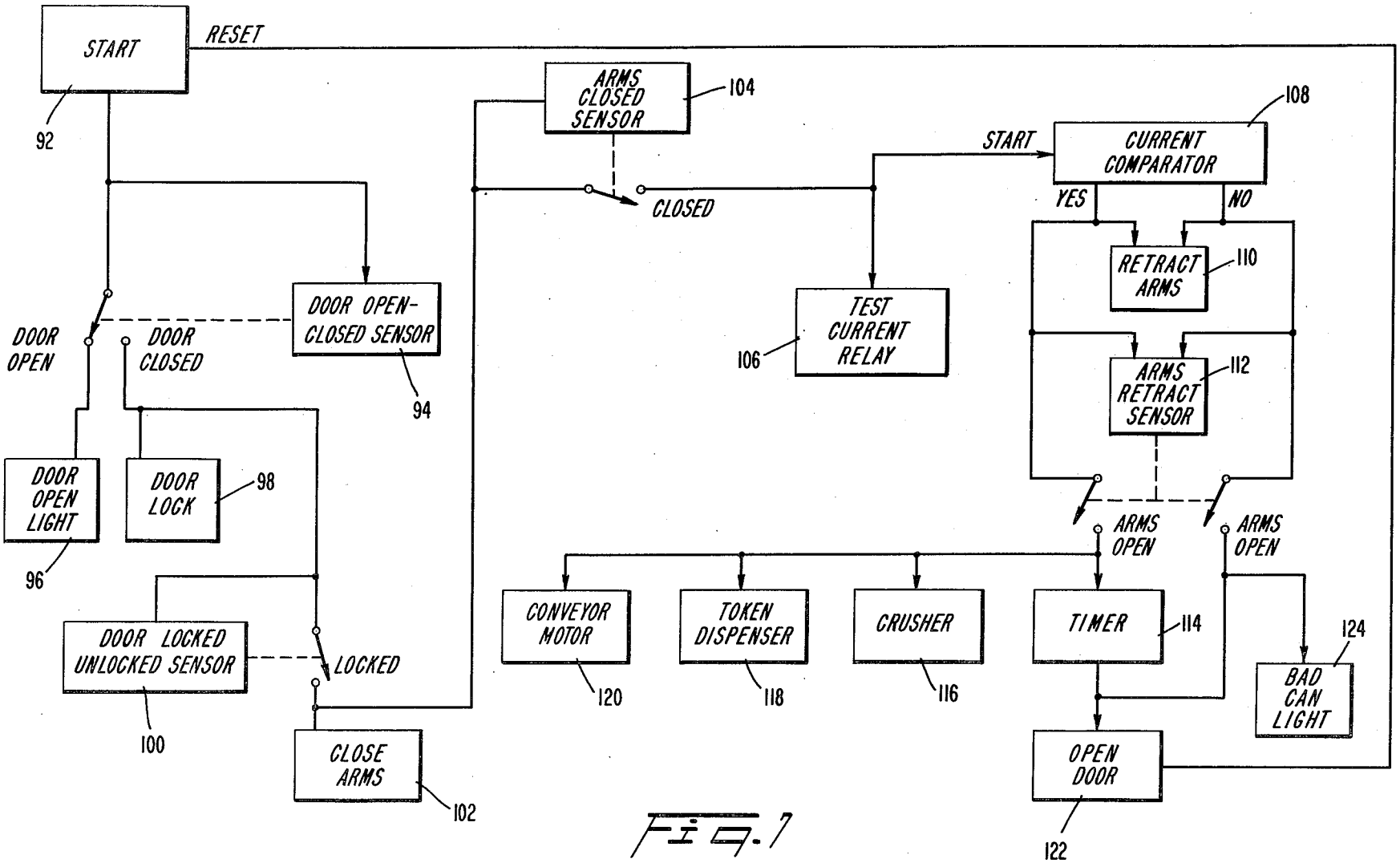
FIG. 7 is a block functional diagram of the electrical components of the apparatus.

In the illustrated embodiment the arms 32 and 33 are actuated by suitable means such as those depicted in FIG. 5. More specifically, the arms 32 and 33 may be operatively connected to a solenoid device 46, which is energized by a push button 48 on the exterior of housing 10. This causes the solenoid to draw downwardly on a T-shaped section connector 50, which in turn, causes the arms 32 and 33 to rotate inwardly until contact is made with a container placed on the shelf 18. The arms 32 and 33 establish electrical contact with spaced-apart locations on the container, allowing an electric current to pass directly through the container. This current is then measured and compared with a referenced standard by suitable electric circuitry (not shown) to verify the metallic composition of the container. FIG. 7 generally depicts in block functional form, a suitable circuit for this purpose. Preferably, the circuitry is designed to verify the presence of an aluminum container. When an acceptable container is determined to be present, the current through arms 32 and 33 is cut off, and the arms then pivot away from the container to their original starting positions under the bias of a pair of springs 52 and 54 and the action of two associated rods 56 and 58.

If a container having a composition other than desired is inserted into the access port 14, and the sensing means are actuated, the identification circuitry will indicate that an undesired container is present, and the apparatus will not operate further to accept the container. Thus, only containers of a predetermined metallic composition will be received and crushed by the apparatus.

When the operation of the preselecting means identifies the composition of the container as a desired one, the rotating belt 16 is rotated upward to bring the next available shelf into alignment with the access port 14.

In accordance with the invention, the apparatus also includes dispensing means responsive to the preselection means for dispensing payment in return for containers having a substantially aluminum composition. As here embodied, the dispensing means includes an interchangeable coin magazine 60 having a plurality of coin tubes 62 mounted vertically about the circumference of the magazine 60. As shown in FIG. 3, a coin chute 64 is provided to channel individual coins or tokens to be dispensed to a slot 66 on the front facing surface 12 of the housing 10. The dispensing means is electrically connected to the sensing means by appropriate circuitry as generally shown in FIG. 7, and is responsive thereto. Thus, a coin is dispensed only in response to receipt of a container of a predetermined metallic composition such as aluminum.

The use of the interchangeable circular coin magazine allows for rapid servicing of the machine since a full coin magazine may be quickly interchanged with the empty or partially filled magazine in the machine.

The coin dispensing means of the apparatus may also include suitable sensors (not shown) to indicate when the coin magazine is emptied and to actuate a signal light on the front of the apparatus.

In accordance with the invention, the apparatus also includes means cooperating with the accepting means for crushing the containers. As here embodied, the crushing means includes a series of rotating crushing wheels 68 arranged within the housing is to receive the individual containers by gravity. A suitable driving mechanism 70 is operatively connected to the crushing wheels 68 for rotation thereof. The driving mechanism 70 includes a chain 71 and a series of gears 73 for controlling the crushing wheel 68. In operation, a container present on a shelf 18 is lifted by the belt 16 and deposited by gravity into the path of the crushing wheels 68. As shown in FIG. 6, the crushing wheels 68 are mounted in progressively closer relation, the lowermost wheels being intermeshed to provide staged compression of the container.

The apparatus also includes storage means for receiving crushed containers from the crushing means and for storing the crushed containers. As here embodied, the storage means comprises a hopper 72 positioned in the lower portion of the housing 10. As illustrated, the hopper is mounted on casters 74 and includes suitable handles 76 for facilitating removal of the hopper from the apparatus. The hopper is accessible by opening the hinged front wall 12 of the housing 10. Alternatively, a separate disposal door 90 may be provided in the housing 10 for removing the hopper 72.

An additional signal light may be provided on the front of the housing 10 indicating when a received container does not have the predetermined metallic composition desired. This signal light is connected to the sensing means by appropriate circuitry (not shown) and is responsive to the sensing means.

The sequence of operation of the apparatus of the present invention is initiated when an operator lifts the door 15 on the front of the housing 10, and inserts a container onto the shelf 18 opposite the access port 14. The operator then closes the door 15 and pushes manual push-button 80 on the front wall 12 of the housing 10. Preferably, appropriate electrical circuitry and sensors (FIG. 7) are provided to verify at this point in the operation of the apparatus that the door 15 is closed. This same circuitry may be utilized to activate an optional signal light 81 on the front wall 12 of the apparatus to indicate that the door 15 is not fully closed. Activation of the manual push-button also energizes a solenoid (not shown) which operates a mechanism for bolting the door 15 securely.

When the door 15 is securely bolted, an appropriate electrical switch (FIG. 7) is closed causing the actuator arm mechanism to be energized. The actuator arms 32 and 33 then rotate inwardly until the contact pads 40 and 44 come into contact with a container on the shelf 18. The circuit including the contact arms 32 and 33, and the metallic container is then exposed to an electric current, and the conductivity of the circuit is measured and compared with a reference by a current comparator to determine if the composition of the container is a desired material. If no acceptable circuit is established through the container or if the container is determined to have an undesireable composition, a signal light 83 is activated on the front wall 12 of the apparatus to indicate that the container is not of the desired composition. The actuator arms are then retracted to their original starting positions and the door 15 is opened automatically.

The above sequence of operation will also take place if the manual push-button 80 is activated with no container present on the shelf. Optionally, appropriate sensing devices may be used in place of the manual push-button 80 to indicated the presence of a container on the shelf 18. In this configuration, the actuator arms 32 and 33 are activated automatically upon closing of the safety door 15.

If an acceptable circuit is established indicating that the composition of the container is of the desired type, the actuator arms 32 and 33 are retracted to their original positions and the motor 28 is started to rotate the belt 16 a sufficient distance to bring the next available shelf 18 into alignment with the access port 14. Simultaneously, a motor 84 is energized causing the driving mechanism 70 to rotate the crushing wheels 68. Thus, a container which has been lifted by the belt 18 and carried to a position adjacent pinion 26 will fall by gravity into the path of the crushing wheels 68.

The coin dispensing mechanism is also activated in response to an indication from the sensing means of the presence of a desired container. As the belt 16 rotates to lift the inserted container out of the path of the access port 14, the coin dispenser ejects a coin through the coin chute 64 to the slot 66. The coin dispenser may also be provided with circuitry to activate a signal light (not shown) on the front of the apparatus for indicating that the apparatus is full, or that no further coins are available for dispensing.

After ejection of the coin and operation of the crushing wheels, for a predetermined period of time sufficient to compress the container, the crushed container falls by gravity into the hopper 72, and the cycle of the apparatus is complete. The automatic lock on the safety door 15 is then electrically released and the machine is ready to receive another container.

The apparatus is designed to operate on standard power supply and is preferably contained within an upright housing which is visually comparable in size to a soft drink dispensing machine.

The block functional diagram in FIG. 7 depicts one embodiment of a circuit for use in the apparatus of this invention. The sequence is initiated by the start block 92 which corresponds to activation of the push-button 80. A door open-closed sensor 94 then checks the status of the door 15. If the door is open, a door-open light 96 is activated. If the door is closed, the door lock 98 is energized and a door locked sensor 100 initiate the closing operation of the arms 32 and 33 (block 102). When the arms are closed a sensor 104 initiates the test current relay 106 to generate a current for comparison in the current comparator 108. If the comparator 108 indicates that a container has the predetermined composition desired, the retract arms sequence 110 is activated. A sensor 112 verifies that the arms are fully retracted, and the timer 114, crusher 116, token dispenser 118 and conveyor 120 are all activated. When the timer 114 deactivates, the door 15 is automatically unlocked (122) and the start sequence is reset.

If an undesired composition is detected by the comparator 108, the retract arms sequence 110 is also activated and sensed by sensor 112. A bad can light is then activated as shown at block 124.

It will be apparent to those skilled in the art that various other electrical circuitry could be used without departing from the scope and spirit of the invention.

The apparatus may be provided with separate access ports to accommodate different sized containers or containers of different composition. In addition, the structure of the apparatus may be modified to allow reception of containers of different compositions, with a different token response for each different container. In addition, modifications to crush and store the different containers in segregated storage locations could be made by those skilled in the art. In addition to the apparatus described in detail above, the invention also comprises a method of collecting and storing empty aluminum containers and issuing payment for containers collected. The method of the present invention comprises the steps of passing an electric current through a crushed or non-crushed container offered by a customer for identifying whether the container is substantially aluminum, accepting only a container identified by passage of the current therethrough as being substantially aluminum, independent of the configuration of the container, dispensing payment for containers accepted, crushing the accepted container, and depositing the crushed containers in a receptacle for storage. The method may be accomplished through the use of the apparatus described above, or through any other suitable apparatus which utilizes the disclosed steps.

It will be apparent to those skilled in the art that various other modifications and variations could be made in the structure of the invention without departing from the scope and spirit of the invention.

What I claim is:

1. Apparatus for collcting and storing empty aluminum containers and for issuing payment for containers collected, comprising:

preselection means for passing an electric current directly through a crushed or non-crushed conainer offered by a customer for identifying whether said container is substantially aluminum, said preselection means including a container access area configured to accommodate both crushed and non-crushed containers for passage of said electric current;

means for accepting only a container identified by said preselection means as being substantially aluminum, independent of the configuration of said container;

dispensing means responsive to said preselection means for dispensing payment in return for containers having a substantially aluminum composition;

means cooperating with said accepting means for crushing said containers; and means for storing crushed containers received from said crushing means.

2. The apparatus of claim 1 wherein said preselection means includes a pair of curved actuator arms for establishing positive electrical contact with spaced-apart locations on said container.

3. The apparatus of claim 2 wherein one end of each said actuator arm is pivotally mounted for arc-rotation in said apparatus.

4. The apparatus of claim 3 wherein each of said actuator arms includes an enlarged electrically-conductive contact pad fixed on the opposite end thereof.

5. The apparatus of claim 4 wherein said accepting means includes conveying means for removing said container from said container access area and depositing said container by gravity into said crushing means.

6. The apparatus of claim 5 wherein said conveying means includes a rotating belt having a plurality of generally horizontal shelves formed thereon, each of said shelves for receiving and supporting a container.

7. The apparatus of claim 6 also including an exterior housing having an access port therein, one of said shelves being positioned adjacent said port for allowing manual insertion of a container into said apparatus onto said one shelf.

8. The apparatus of claim 7 wherein said housing includes a safety door for covering said access port, and means preventing operation of said apparatus when said safety door is open.

9. The apparatus of claim 8 also including means responsive to the insertion of a container into said access port for actuating said preselection means upon closing of said safety door.

10. The apparatus of claim 8 also including manual push-button means for actuating said preselection means.

11. The apparatus of claim 10 wherein said preselection means includes regret means for actuating a signal when a received container does not have a substantially aluminum composition.

12. The apparatus of claim 11 wherein said means for storing comprises a hopper and said housing includes a disposal door for permitting removal of said hopper.

13. The apparatus of claim 12 wherein said dispensing means includes an interchangeable circular coin magazine, said magazine having a plurality of coin tubes mounted vertically about the circumference of said magazine.

14. A method of collecting and storing empty aluminum containers and issuing payment for containers collected, comprising the steps of:

passing an electric current through a crushed or non-crushed container offered by a customer for identifying whether said container is substantially aluminum;

accepting only a container identified by passage of said current as being substantially aluminum, independent of the configuration of said container;

dispensing payment for containers accepted;

crushing the accepted containers; and depositing the crushed containers in a receptacle for storage.

* * * * *

UNITED STATES PATENT AND TRADEMARK OFFICE

CERTIFICATE OF CORRECTION

PATENT NO. : 4,324,325

DATED : April 13, 1982

INVENTOR(S) : Bruce H. DeWoolfson

It is certified that error appears in the above—identified patent and that said Letters Patent is hereby corrected as shown below:

In the Abstract, line 2, change "therefo" to --therefor--.

line 3, change "havig" to --having--.

Column 7, line 39, change "collcting" to --collecting--.

Signed and Sealed this

*Thirty-first* Day of *August 1982*

[SEAL]

*Attest:*

GERALD J. MOSSINGHOFF

*Attesting Officer*

*Commissioner of Patents and Trademarks*